US012576957B2

(12) United States Patent
Hasegawa

(10) Patent No.: US 12,576,957 B2
(45) Date of Patent: Mar. 17, 2026

(54) OUTBOARD MOTOR AND VESSEL

(71) Applicant: YAMAHA HATSUDOKI KABUSHIKI KAISHA, Iwata (JP)

(72) Inventor: Hiroyuki Hasegawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 387 days.

(21) Appl. No.: 18/223,076

(22) Filed: Jul. 18, 2023

(65) Prior Publication Data

US 2024/0140577 A1 May 2, 2024

(30) Foreign Application Priority Data

Oct. 31, 2022 (JP) ..... 2022-174281

(51) Int. Cl.
*B63H 20/24* (2006.01)
*B63H 20/32* (2006.01)

(52) U.S. Cl.
CPC ..... *B63H 20/245* (2013.01); *B63H 20/32* (2013.01)

(58) Field of Classification Search
CPC ..... B63H 20/00; B63H 20/24; B63H 20/245; B63H 20/32; F02B 61/045
USPC ..... 440/76, 77, 89, 89 R
See application file for complete search history.

(56) References Cited

U.S. PATENT DOCUMENTS 7,867,048 B2 * 1/2011 Ochiai ..... F02B 61/045 440/89 R
8,011,985 B2 * 9/2011 Ochiai ..... F01N 13/004 440/89 R
8,118,631 B2 * 2/2012 Ochiai ..... F02B 61/045 440/89 R
10,640,189 B2 * 5/2020 Hasegawa ..... B63H 20/245
2019/0002071 A1 1/2019 Hasegawa

FOREIGN PATENT DOCUMENTS

JP 2019-010992 A 1/2019

* cited by examiner

*Primary Examiner* — Daniel V Venne
(74) *Attorney, Agent, or Firm* — Keating & Bennett, LLP

(57) ABSTRACT

An outboard motor includes an engine, a fan, and a top cowl assembly. The fan suctions air around the engine and discharges the air through a discharge port. The top cowl assembly includes a top cowl to house the engine and the fan, and a cover to cover at least a portion of an outside of the top cowl. The top cowl assembly includes an exhaust port to communicate with the discharge port via an exhaust channel. At least a portion of the exhaust channel is defined by a surface of the top cowl and a surface of the cover.

14 Claims, 8 Drawing Sheets

OUTBOARD MOTOR AND VESSEL

CROSS-REFERENCE TO RELATED APPLICATIONS

This application claims the benefit of priority to Japanese Patent Application No. 2022-174281 filed on Oct. 31, 2022. The entire contents of this application are hereby incorporated herein by reference.

BACKGROUND OF THE INVENTION

1. Field of the Invention

The technology disclosed herein relates to an outboard motor and a vessel.

2. Description of the Related Art

A vessel includes a hull and an outboard motor attached to a rear portion of the hull. The outboard motor is a device that generates a thrust force to propel the vessel.

The outboard motor includes an engine and a cowl housing the engine. In the cowl of the outboard motor, a fan is provided to suction the air around the engine and discharge the air through a discharge port in order to exhaust heat near the engine. The air discharged from the discharge port of the fan is discharged to outside through an exhaust port formed in the cowl.

There is a conventionally known configuration in which a dedicated component is provided to form an exhaust channel from the discharge port of the fan to the exhaust port formed in the cowl (see JP2019-10992A, for example).

In the conventional configuration described above, a dedicated component is provided to form the exhaust channel to exhaust the heat, which leaves room for improvements in terms of weight reduction, downsizing, and simplification of the configuration of the outboard motor.

SUMMARY OF THE INVENTION

Preferred Embodiments of the Present Invention provide solutions to the issue described above.

Preferred Embodiments of the Present Invention disclosed herein may be implemented in the following aspects.

An outboard motor according to a preferred embodiment of the present invention includes an engine, a fan, and a top cowl assembly. The fan suctions air around the engine and discharges the air through a discharge port. The top cowl assembly includes a top cowl to house the engine and the fan, and a cover to cover at least a portion of an outside of the top cowl. The top cowl assembly includes an exhaust port to communicate with the discharge port via an exhaust channel. At least a portion of the exhaust channel is defined by a surface of the top cowl and a surface of the cover.

In the outboard motor, at least a portion of the exhaust channel extending from the discharge port of the fan to the exhaust port in the top cowl assembly is defined by the surface of the top cowl and the surface of the cover. Therefore, with the outboard motor, the space between the top cowl and the cover may be used as the exhaust channel to exhaust air without providing a dedicated element to define the exhaust channel, and the outboard motor may have a lighter, smaller, and simpler configuration.

Another outboard motor according to a preferred embodiment of the present invention includes an engine, a fan, and a top cowl assembly. The fan suctions air around the engine and discharges the air through a discharge port. The top cowl assembly includes a top cowl to house the engine and the fan, and a cover to cover at least a portion of an outside of the top cowl. The top cowl assembly includes an exhaust port to communicate with the discharge port via an exhaust channel. The exhaust port is located in a foremost portion of the top cowl assembly.

In the outboard motor, the exhaust port may be located at a position closest to the hull, i.e., at a position that is less likely to be contacted by waves and splashes due to the presence of the hull, and thus it is possible to effectively prevent water from entering the inside of the top cowl assembly through the exhaust port.

The preferred embodiments of the present invention may be implemented in various aspects such as an outboard motor or a vessel including an outboard motor and a hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
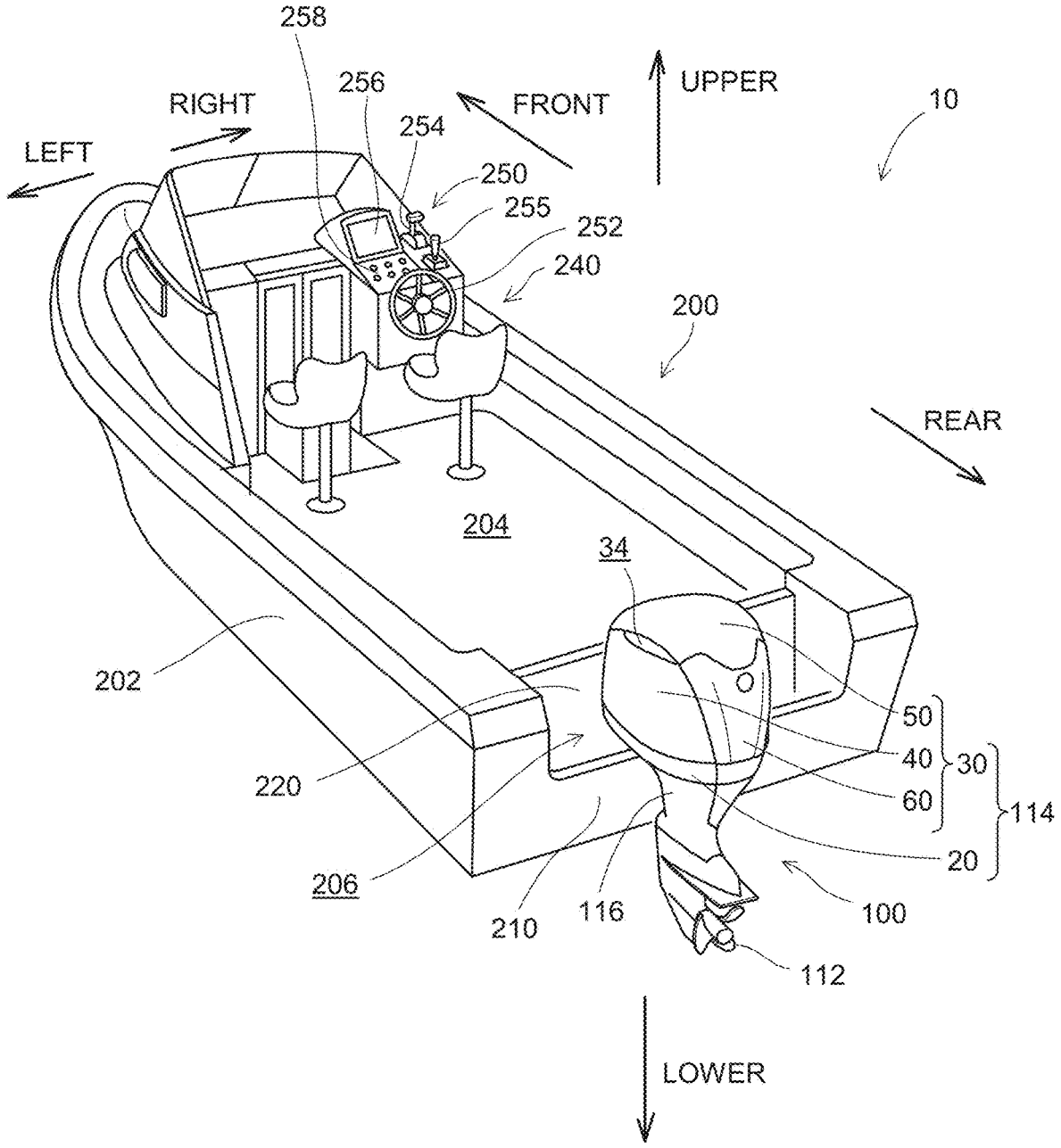
FIG. 1 is a perspective view schematically illustrating a configuration of a vessel according to a preferred embodiment of the present invention.

FIG. 1 is a perspective view schematically illustrating a configuration of the vessel 10 according to a preferred embodiment of the present invention. FIG. 1 and the other figures described below illustrate the arrow indicating each direction with respect to the position of the vessel 10. More specifically, each figure illustrates the arrows indicating a front side (FRONT), a rear side (REAR), a left side (LEFT), a right side (RIGHT), an upper side (UPPER), and a lower side (LOWER). The front-rear direction, the right-left direction, and the up-down direction (vertical direction) are perpendicular to each other.

The vessel 10 includes a hull 200 and an outboard motor 100. According to the present preferred embodiment, the vessel 10 includes one outboard motor 100, but may include a plurality of outboard motors 100.

The hull 200 is a portion of the vessel 10 which a passenger gets on board. The hull 200 includes a hull main body portion 202 including a living space 204, a cockpit 240 provided in the living space 204, and an operating device 250 provided near the cockpit 240. The operating device 250 operates the vessel and includes, for example, a steering wheel 252, a shift/throttle lever 254, a joystick 255, a monitor 256, and an input device 258. The hull 200 further includes a partition wall 220 that defines a rear end of the living space 204 and a transom 210 located at the rear end of the hull 200. In the front-rear direction, a space 206 is provided between the transom 210 and the partition wall 220.

Figure 2:
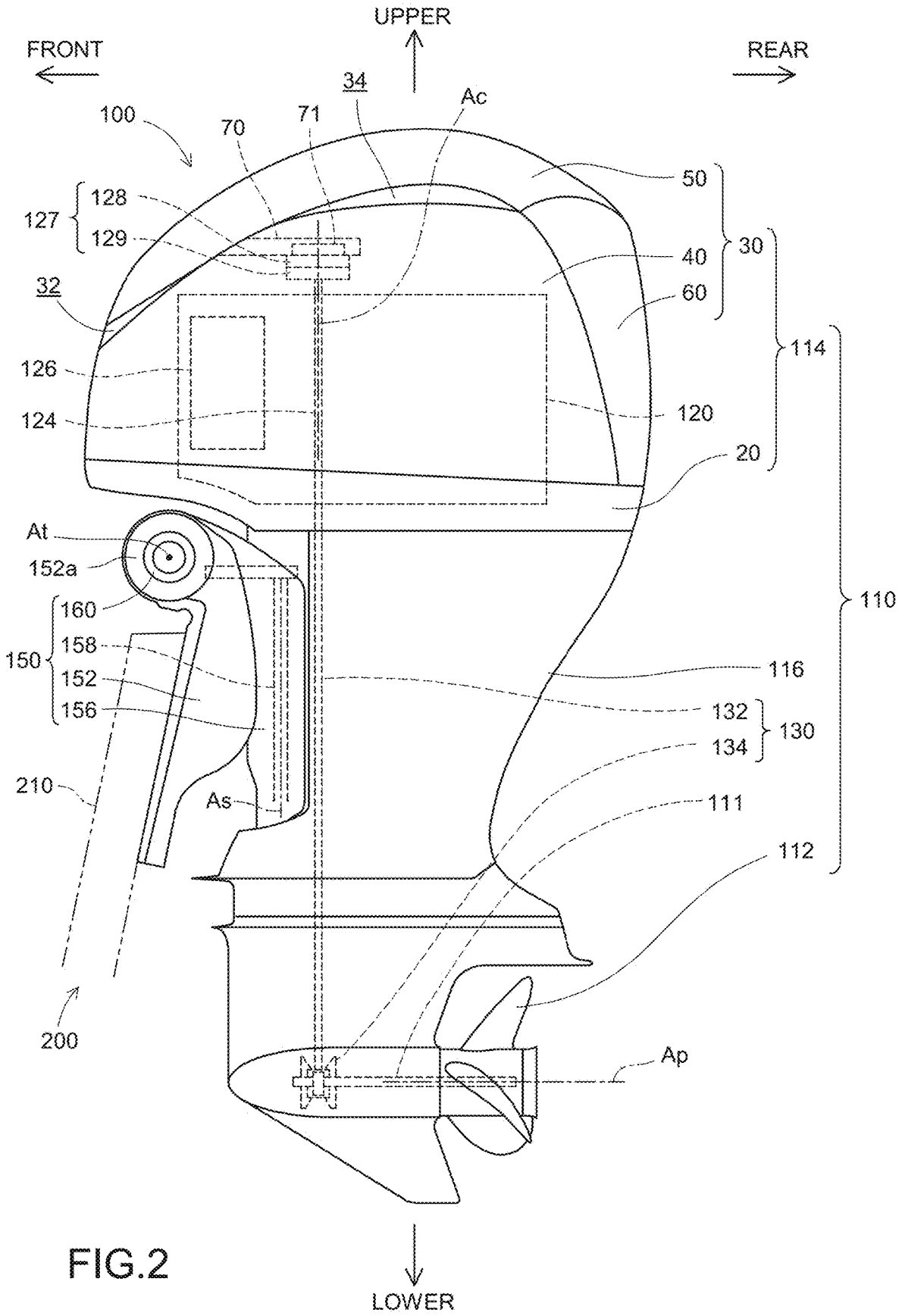
FIG. 2 is a side view schematically illustrating a configuration of an outboard motor.

FIG. 2 is a side view schematically illustrating a configuration of the outboard motor 100. The outboard motor 100 in a reference posture is described below unless otherwise noted. The reference posture is such that a rotation axis Ac of a crankshaft 124 described below extends in the up-down direction and a rotation axis Ap of a propeller shaft 111 extends in the front-rear direction. The front-rear direction, the right-left direction, and the up-down direction are defined based on the outboard motor 100 in the reference posture.

The outboard motor 100 generates a thrust force to propel the vessel 10. The outboard motor 100 is attached to the transom 210 at the rear portion of the hull 200. The outboard motor 100 includes an outboard motor main body 110 and a suspension device 150.

The outboard motor main body 110 includes an engine 120, the propeller shaft 111, a propeller 112, a transmission mechanism 130, a flywheel magnet generator 127, a fan 70, a cowl 114, and a casing 116.

Figure 3:
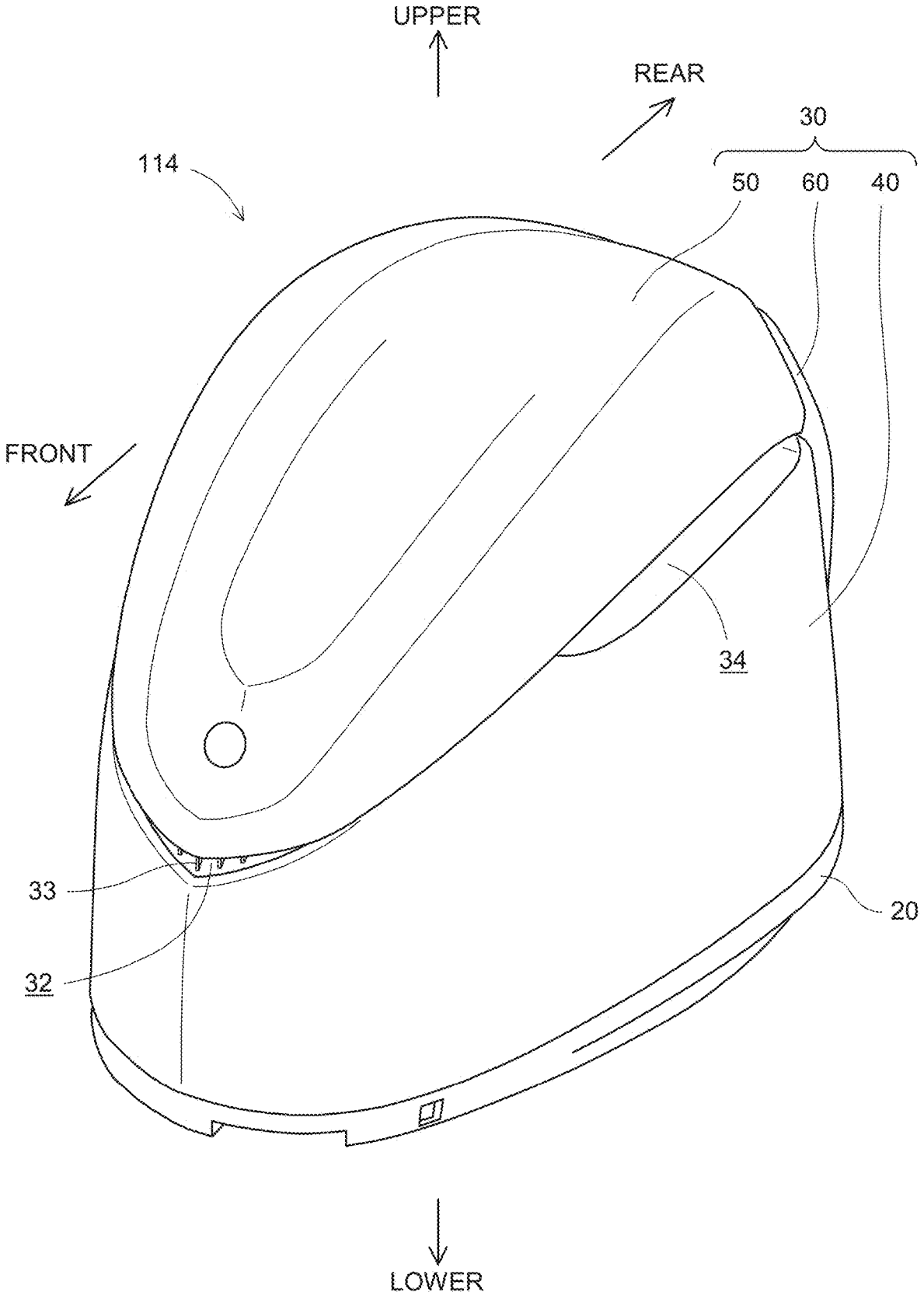
FIG. 3 is an explanatory diagram illustrating an external configuration of a cowl.

FIG. 3 is an explanatory diagram illustrating an external configuration of the cowl 114. The cowl 114 is a housing located in an upper portion of the outboard motor main body 110. The cowl 114 includes a bottom cowl 20 defining a lower portion of the cowl 114 and a top cowl assembly 30 defining an upper portion of the cowl 114. The top cowl assembly 30 is removably attached to the bottom cowl 20.

Figure 4:
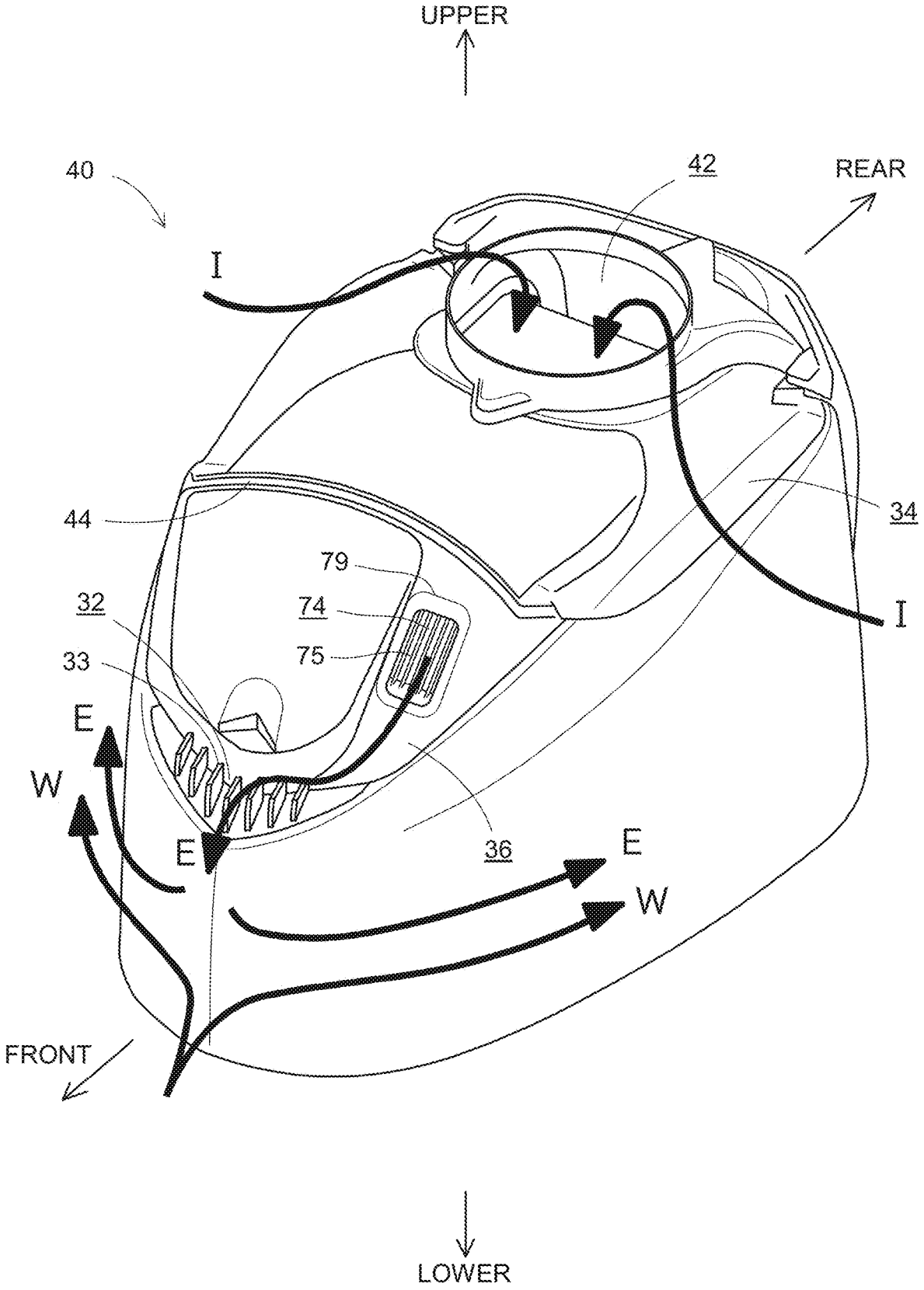
FIG. 4 is an explanatory diagram illustrating an external configuration of a top cowl.

The top cowl assembly 30 includes a top cowl 40, a top cover member 50, and a rear cover member 60. FIG. 4 is an explanatory diagram illustrating an external configuration of the top cowl 40. The top cowl 40 is a housing that houses the engine 120. The top cover member 50 covers an upper portion of the top cowl 40 from the outside and is attached to the upper portion of the top cowl 40. The rear cover member 60 covers a rear portion of the top cowl 40 from the outside and is attached to the rear portion of the top cowl 40. The top cover member 50 is an example of a cover.

The casing 116 is a housing located below the cowl 114 and in a lower portion of the outboard motor main body 110.

The engine 120 generates power and is housed in the top cowl 40. The engine 120 includes, for example, an internal combustion engine. The engine 120 includes the crankshaft 124 that converts a reciprocating motion of a piston (not illustrated) into a rotational motion. The crankshaft 124 is provided in such a posture that the rotation axis Ac extends in the up-down direction. The engine 120 includes an intake-related component 126 (e.g., silencer or throttle body).

The flywheel magnet generator 127 is an alternating-current generator as an auxiliary device for the engine 120 and is housed above the engine 120 in the top cowl 40. The flywheel magnet generator 127 includes a flywheel rotor 128 and a stator 129. The flywheel rotor 128 is coupled to an upper end portion of the crankshaft 124 to rotate along with the rotation of the crankshaft 124.

The fan 70 is a blower that suctions air around the engine 120 and discharges the air through a discharge port 74 described below in order to exhaust the heat near the engine 120. The fan 70 is housed above the flywheel magnet generator 127 (i.e., above the engine 120) in the top cowl 40. The configuration of the fan 70 will be described below in detail.

The propeller shaft 111 is a rod-shaped member and is located in a relatively lower position in the outboard motor main body 110 in a posture extending in the front-rear direction. A front end portion of the propeller shaft 111 is housed in the casing 116, and a rear end portion of the propeller shaft 111 protrudes to the rear side from the casing 116.

The propeller 112 is a rotor including a plurality of blades and is attached to a rear end portion of the propeller shaft 111. The propeller 112 also rotates along with the rotation of the propeller shaft 111 around the rotation axis Ap. The propeller 112 rotates to generate a thrust force.

The transmission mechanism 130 transmits the rotation of the engine 120 to the propeller shaft 111. At least a portion of the transmission mechanism 130 is housed in the casing 116. The transmission mechanism 130 includes a drive shaft 132 and a shift mechanism 134.

The drive shaft 132 is a rod-shaped member and is located below the crankshaft 124 of the engine 120 in a posture extending in the up-down direction. An upper end portion of the drive shaft 132 is coupled to the crankshaft 124. The drive shaft 132 rotates along with the rotation of the engine 120 (the rotation of the crankshaft 124).

The shift mechanism 134 is coupled to a lower end portion of the drive shaft 132 and is coupled to a front end portion of the propeller shaft 111. The shift mechanism 134 includes, for example, a plurality of gears and a clutch that switches the engagement of the gears, and transmits the rotation of the drive shaft 132 caused by the rotation of the engine 120 to the propeller shaft 111 in such a manner that the rotation direction may be switched. When the shift mechanism 134 transmits the rotation of the drive shaft 132 as the rotation in a forward direction to the propeller shaft 111, the propeller 112 rotating in the forward direction together with the propeller shaft 111 generates a thrust force in the forward direction. Conversely, when the shift mechanism 134 transmits the rotation of the drive shaft 132 as the rotation in a reverse direction to the propeller shaft 111, the propeller 112 rotating in the reverse direction together with the propeller shaft 111 generates a thrust force in the backward direction.

The suspension device 150 suspends the outboard motor main body 110 on the hull 200. The suspension device 150 includes a pair of right and left clamp brackets 152, a tilt shaft 160, a swivel bracket 156, and a steering shaft 158.

The pair of right and left clamp brackets 152 are located in the rear portion of the hull 200 with a space between each other in the right-left direction and secured to the transom 210 of the hull 200 with bolts, for example. Each of the clamp brackets 152 includes a cylindrical support portion 152*a* provided with a through-hole extending in the right-left direction.

The tilt shaft 160 is a rod-shaped member and is rotatably supported in the through-hole in the support portion 152*a* of the clamp bracket 152. A tilt axis At, which is the center line of the tilt shaft 160, defines an axis extending in a horizontal direction (right-left direction) during a tilt operation of the outboard motor 100.

The swivel bracket 156 is located between the pair of clamp brackets 152 and is supported by the support portion 152*a* of the clamp bracket 152 via the tilt shaft 160 so as to be rotatable around the tilt axis At. The swivel bracket 156 is driven by a tilt device (not illustrated) including an actuator such as a hydraulic cylinder to rotate around the tilt axis At with respect to the clamp bracket 152.

The steering shaft 158 is a rod-shaped member and is supported by the swivel bracket 156 in a posture extending in the up-down direction so as to be rotatable around the steering axis As, which is the center line of the steering shaft 158. The steering shaft 158 is driven by a steering device (not illustrated) including an actuator such as a hydraulic cylinder to rotate around the steering axis As with respect to the swivel bracket 156.

The outboard motor main body 110 is secured to the steering shaft 158. Therefore, when the steering shaft 158 rotates around the steering axis As with respect to the swivel bracket 156, the outboard motor main body 110 secured to the steering shaft 158 also rotates around the steering axis As. Accordingly, the direction of the thrust force generated by the propeller 112 with respect to the direction of the hull 200 is changed, and thus steering of the vessel 10 is achieved.

When the swivel bracket 156 rotates around the tilt axis At with respect to the clamp bracket 152, the steering shaft 158 supported by the swivel bracket 156 and the outboard motor main body 110 secured to the steering shaft 158 also rotate around the tilt axis At. This enables a tilt operation to rotate the outboard motor main body 110 in the up-down direction with respect to the hull 200. The tilt operation of the outboard motor 100 may change the angle of the outboard motor main body 110 around the tilt axis At in the range from a tilt-down state where the propeller 112 is in the water (the state where the outboard motor 100 is in the reference posture) to a tilt-up state where the propeller 112 is located above the water surface. A trim operation may also be performed to adjust the angle of the outboard motor main body 110 around the tilt axis At and thus adjust the posture of the vessel 10 during traveling.

Figure 5:
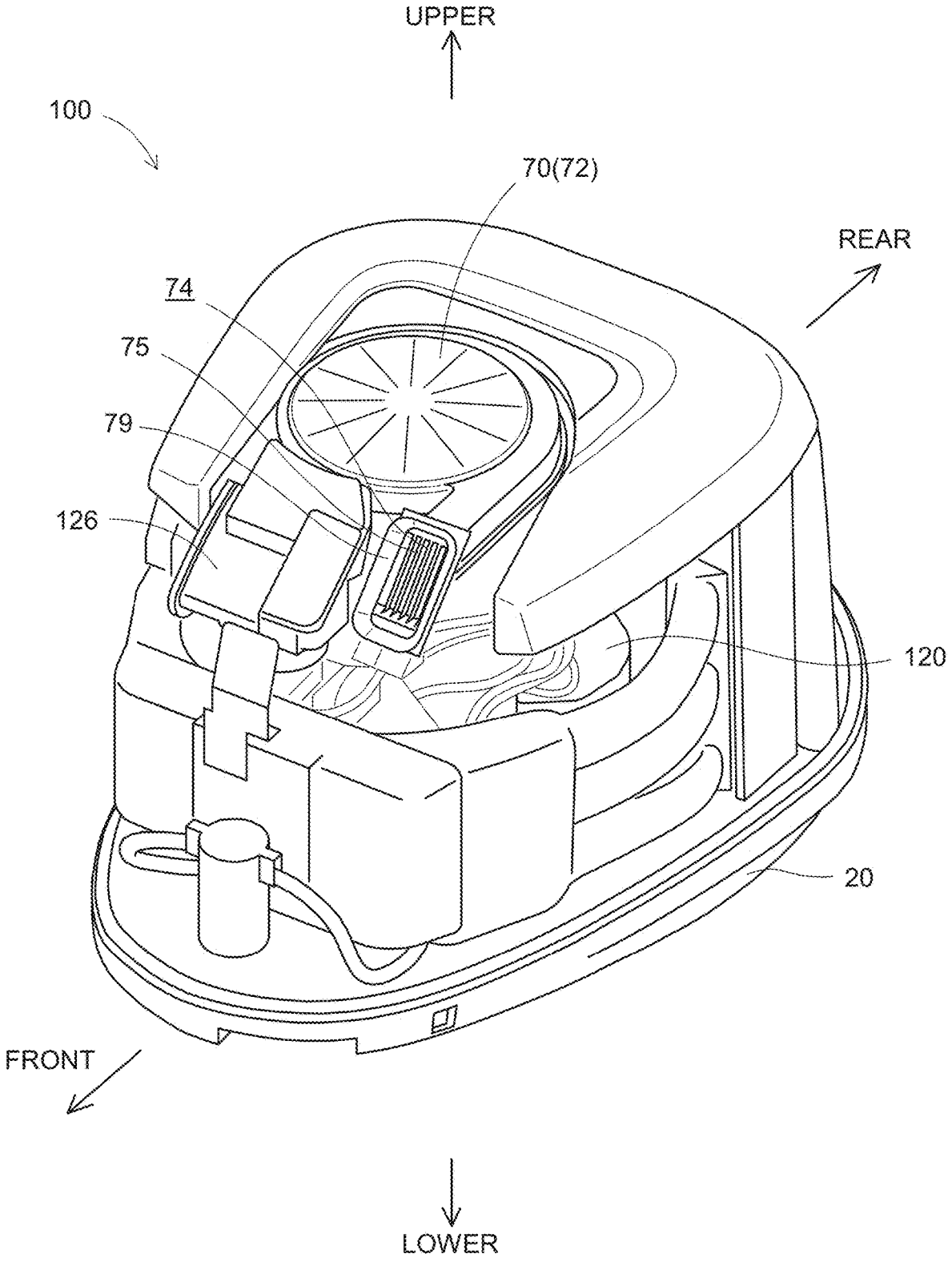
FIG. 5 is an explanatory diagram illustrating an external configuration of an upper portion of the outboard motor from which a top cowl assembly is removed.
Figure 6:
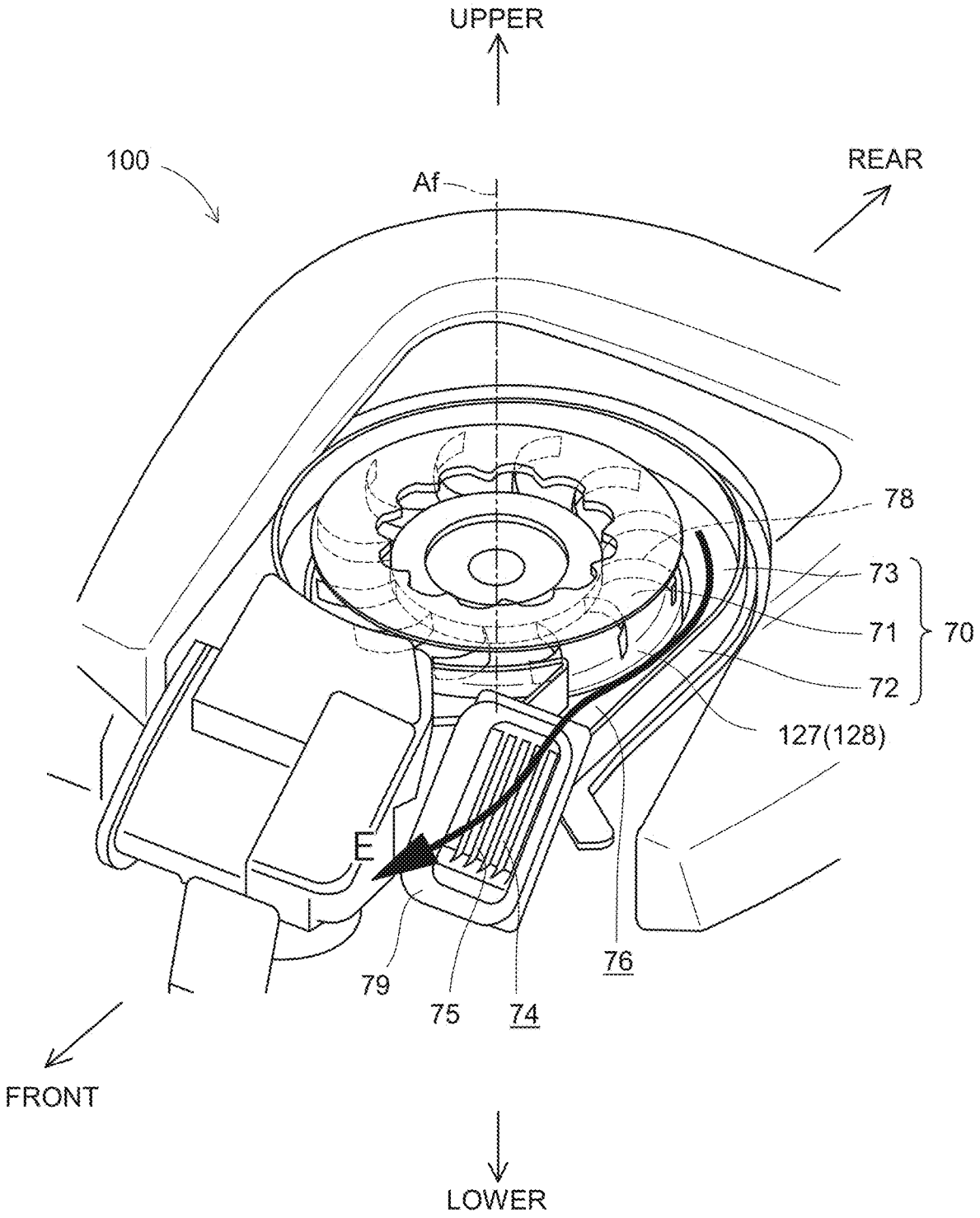
FIG. 6 is an enlarged view of a portion of FIG. 5.
Figure 7:
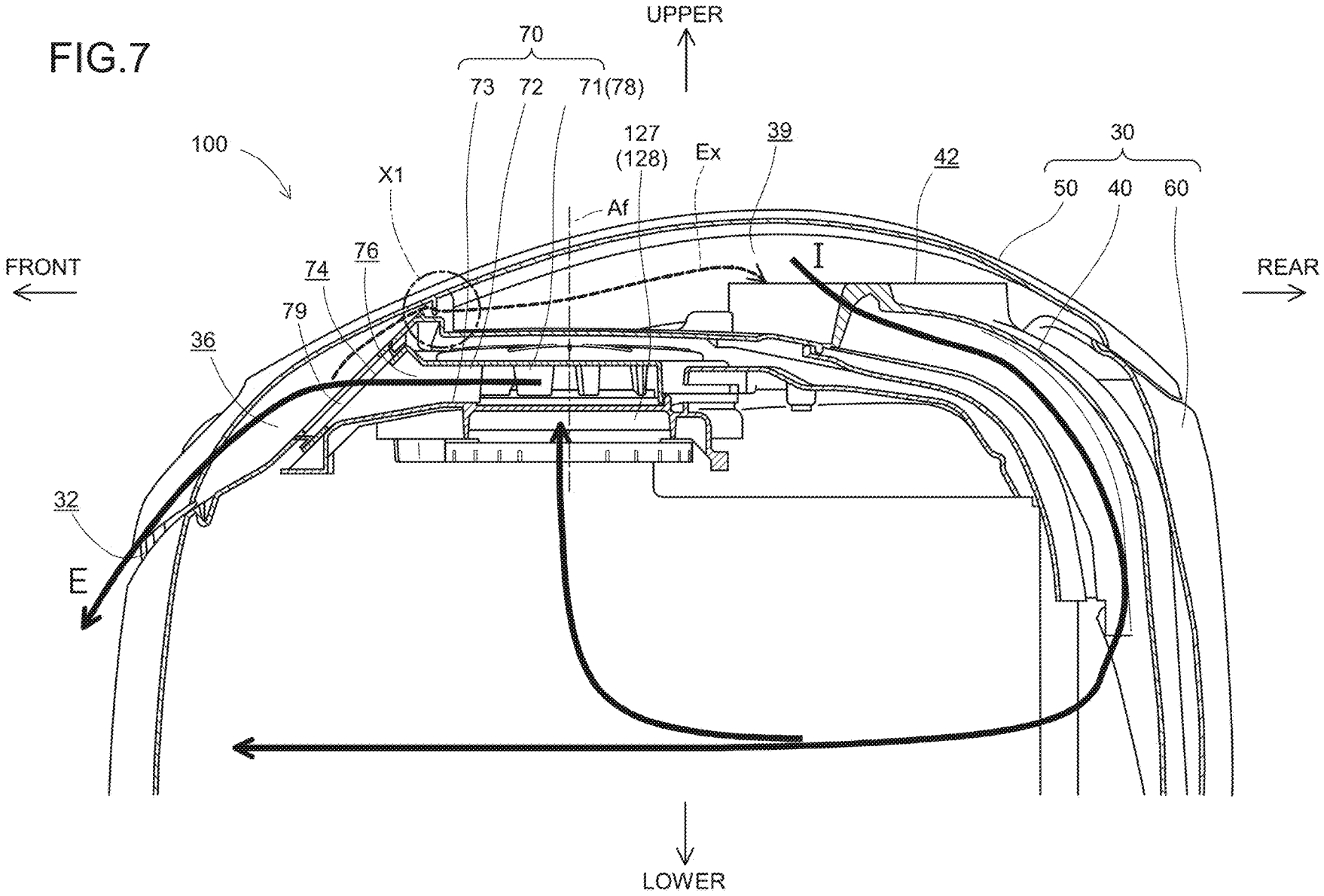
FIG. 7 is an explanatory diagram illustrating a configuration of the upper portion of the outboard motor in cross-section (the cross-section perpendicular to a right-left direction).

Next, the configuration of the fan 70 and its periphery in the outboard motor 100 will be described. FIG. 5 is an explanatory diagram illustrating an external configuration of an upper portion of the outboard motor 100 from which the top cowl assembly 30 is removed, FIG. 6 is an enlarged view of a portion of FIG. 5, and FIG. 7 is an explanatory diagram illustrating a configuration of the upper portion of the outboard motor 100 in cross-section (the cross-section perpendicular to the right-left direction). In FIG. 6, a portion of a shroud cover 72 described below is not illustrated so as to describe the internal configuration of the fan 70.

As described above, the fan 70 is a blower that suctions the air around the engine 120 and discharges the air through the discharge port 74 to exhaust heat near the engine 120. The fan 70 includes a rotor 71, a shroud 73, and the shroud cover 72.

The rotor 71 has substantially a cylindrical shape and is installed to be rotatable around an axis Af extending in the up-down direction. The rotor 71 includes a plurality of blades 78 arranged evenly or substantially evenly around the axis Af. The rotor 71 is coupled to the flywheel rotor 128 of the flywheel magnet generator 127 (FIG. 2) to rotate along with the rotation of the flywheel rotor 128. As described above, the flywheel rotor 128 rotates along with the rotation of the crankshaft 124 of the engine 120, and therefore the fan 70 including the rotor 71 is driven by the engine 120.

The shroud 73 is located above the engine 120, and the shroud cover 72 is located above the shroud 73 and is coupled to the shroud 73. The shroud 73 and the shroud cover 72 define a chassis surrounding the rotor 71. The shroud 73 is provided with a through-hole extending in the up-down direction, and the flywheel rotor 128 is fitted into the through-hole. The shroud 73 and the shroud cover 72 define, inside the fan 70, a discharge channel 76 extending from the periphery of the rotor 71 to the discharge port 74. More specifically, the shroud 73 primarily defines a lower surface of the discharge channel 76, and the shroud cover 72 primarily defines a side surface and an upper surface of the discharge channel 76. As illustrated in FIG. 7, the discharge channel 76 extends in the horizontal direction. In this description, the horizontal direction is not limited to the precise horizontal direction, but includes a direction at a tilt within 15 degrees from the horizontal direction. The discharge channel 76 extending in the horizontal direction may, for example, reduce the pressure drop in the discharge channel 76 and improve exhaust efficiency. The shroud 73 and the shroud cover 72 are an example of a discharge channel structure.

When the rotor 71 of the fan 70 rotates, the air around the engine 120 is suctioned into the fan 70 through the through-hole in the flywheel rotor 128, and the suctioned air is pushed due to the rotation of the rotor 71 toward the discharge channel 76 around the rotor 71 and is discharged through the discharge channel 76 from the discharge port 74. This achieves exhaust of the heat near the engine 120.

As illustrated in FIGS. 4 and 7, the discharge port 74, which is the end of the discharge channel 76 of the fan 70, is located on the upper surface of the top cowl 40. The top cover member 50, which covers the top cowl 40 from the outside, is attached to the top cowl 40, and therefore the discharge port 74 is not exposed to the outside (see FIG. 3). A seal 79 is located between the discharge port 74 and the upper surface of the top cowl 40. A louver 75 is provided at the discharge port 74 to prevent entry of foreign matter, etc.

As illustrated in FIGS. 3, 4, and 7, the top cowl assembly 30 is provided with an exhaust port (heat exhaust port) 32 to discharge the air discharged from the discharge port 74 of the fan 70 to the outside of the outboard motor 100. The term "exhaust" here refers to exhaust to exhaust heat near the engine 120 and is different from exhaust gas from the engine 120. The exhaust port 32 is located in a foremost portion of the top cowl assembly 30. In this description, the foremost portion of the top cowl assembly 30 refers to the portion at the forefront of the top cowl assembly 30 that is equally divided into five hypothetical portions along the front-rear direction.

Inside the top cowl assembly 30, there is a space that is defined by the surface (upper surface) of the top cowl 40 and the surface (lower surface) of the top cover member 50 and communicates with the exhaust port 32. The space defines an exhaust channel 36 that communicates from the discharge port 74 of the fan 70 to the exhaust port 32. Specifically, the air discharged from the discharge port 74 of the fan 70 reaches the exhaust port 32 via the exhaust channel 36 and is discharged from the exhaust port 32 to the outside of the outboard motor 100. As illustrated in FIG. 4, the air discharged from the exhaust port 32 to the outside is suctioned out by the negative pressure due to running winds W to form exhaust flows E rearward on right and left sides of the top cowl 40.

As illustrated in FIGS. 3 and 4, the top cowl assembly 30 includes an intake port 34 to take in the air to the engine 120. According to the present preferred embodiment, the two right and left intake ports 34 are located from a center portion to a rear portion of the top cowl assembly 30 in the front-rear direction. The intake port 34 is located between the top cowl 40 and the top cover member 50, which define the top cowl assembly 30. A through-hole 42 is in the upper surface of the top cowl 40, and as illustrated by intake air flows I in FIGS. 4 and 7, the air introduced through the intake ports 34 enters the inside of the top cowl 40 through the through-hole 42 and is taken in by the intake-related component 126 of the engine 120. A portion of the air introduced through the intake port 34 is suctioned by the fan 70 and discharged to the outside through the discharge port 74 and the exhaust port 32 to exhaust the heat near the engine 120, as described above.

As illustrated in FIG. 7, the exhaust channel 36 has a descending slope from the discharge port 74 of the fan 70 toward the exhaust port 32. Therefore, even when water enters the exhaust channel 36 through the exhaust port 32, the descending slope of the exhaust channel 36 allows prompt draining and prevention of water entry beyond the exhaust channel 36. When the horizontal direction is 0 degrees, the slope of the exhaust channel 36 is preferably, for example, about 5 degrees or more and about 60 degrees or less, more preferably about 10 degrees or more and about 55 degrees or less, and even more preferably about 15 degrees or more and about 50 degrees or less.

As illustrated in FIG. 4, the discharge port 74 is located at an eccentric or offset position (a position closer to the left side) in the right-left direction of the outboard motor 100, while the exhaust port 32 is located at the center of the outboard motor 100 in the right-left direction. Therefore, the exhaust channel 36 extending from the discharge port 74 to the exhaust port 32 extends diagonally from the eccentric position in the right-left direction to the central position. This may prevent the entry of water from the exhaust channel 36 to the inside of the fan 70 via the discharge port 74, even when water enters the exhaust channel 36 via the exhaust port 32, for example. As illustrated in FIGS. 4 and 7, the exhaust channel 36 is located at a position that does not overlap with the fan 70 when viewed in the up-down direction. Accordingly, for example, a reduction in the complexity of the exhaust channel 36 may result in a reduction in the pressure drop and an improvement in exhaust efficiency.

The width of the exhaust port 32 is larger than the height of the exhaust port 32. As the exhaust port 32 is horizontally elongated, for example, it is possible to effectively prevent water from entering the inside of the top cowl assembly 30 through the exhaust port 32. Furthermore, as the exhaust port 32 is horizontally elongated, it is possible to move more exhaust air from the exhaust port 32 toward the sides of the outboard motor 100 and prevent exhaust air from the exhaust port 32 from flowing back into the inside of the top cowl assembly 30 through other openings (e.g., the intake port 34). The ratio of the width to the height of the exhaust port 32 is preferably, for example, about 1.5 or more and about 5.0 or less, more preferably about 2.0 or more and about 4.5 or less, and even more preferably about 2.5 or more and about 4.0 or less.

The exhaust port 32 is located between the top cowl 40 and the top cover member 50, which define the top cowl assembly 30. Accordingly, for example, without providing an opening as an exhaust port in the top cowl 40 or the top cover member 50, the space between the top cowl 40 and the top cover member 50, including a foremost edge of the top cover member 50, may be used as the exhaust port 32 (see FIGS. 2, 3, and 7).

As illustrated in FIGS. 3 and 4, the louver 33 is provided in the exhaust port 32. This may prevent, for example, entry of foreign matter (e.g., mooring rope getting stuck) into the exhaust port 32. The color of the front surface of the louver 33 is different from the colors of other areas of the louver 33. This makes it possible to, for example, make the presence of the exhaust port 32 more visible and effectively prevent the entry of foreign matter into the exhaust port 32. For example, the front surface of the louver 33 may be white and the other areas of the louver 33 may be black.

Figure 8:
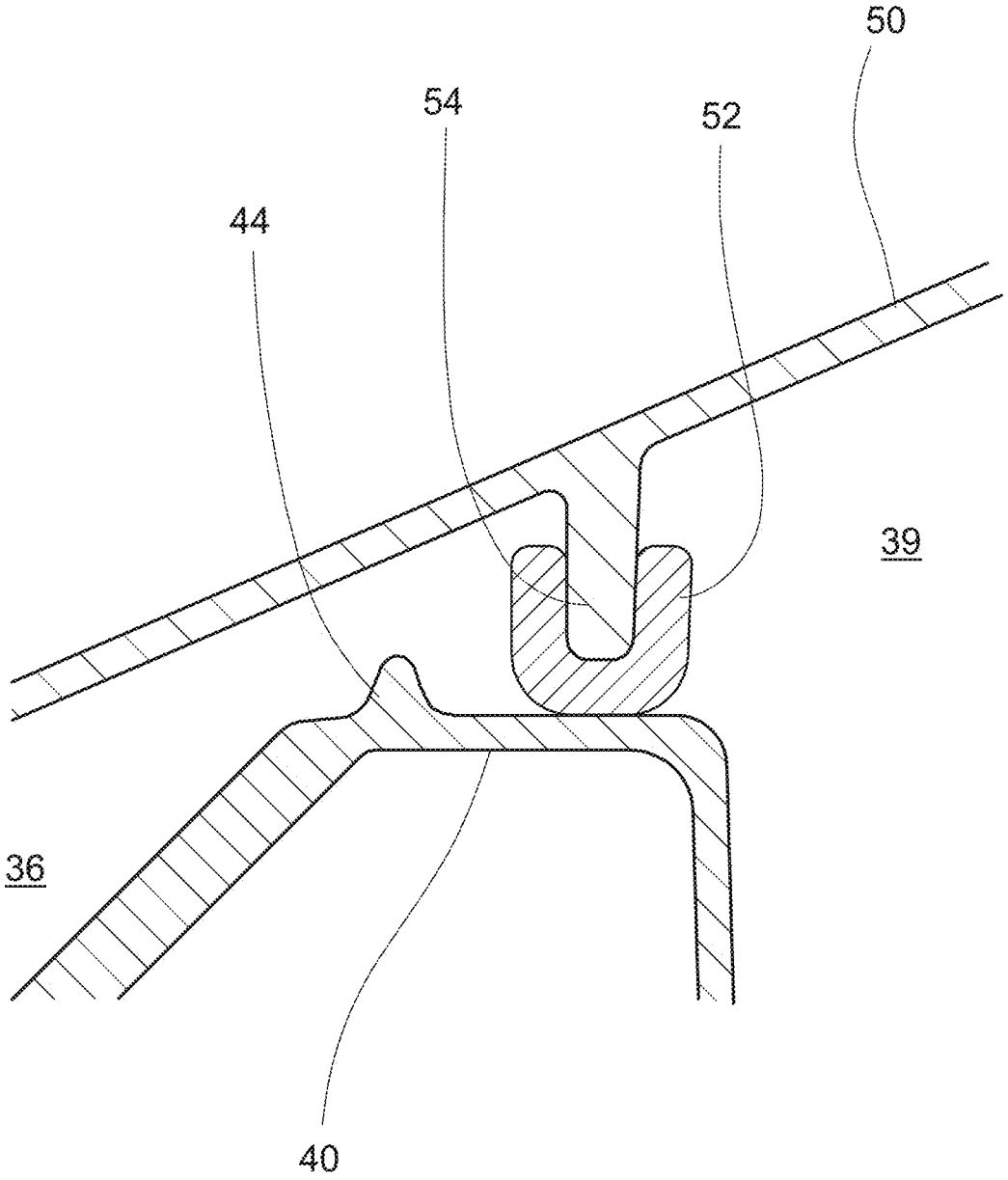
FIG. 8 is an enlarged view of a portion X1 of FIG. 7.

FIG. 8 is an enlarged view of a portion X1 of FIG. 7. As illustrated in FIGS. 4, 7, and 8, a continuous protruding portion 44 is provided on the upper surface of the top cowl 40, and a continuous protruding portion 54 is provided on the lower surface of the top cover member 50 at a position immediately behind the protruding portion 44 of the top cowl 40. The protruding portion 44 and the protruding portion 54 define a labyrinth structure, which inhibits an air flow Ex (see FIG. 7) from the exhaust channel 36 to a space 39 facing the intake port 34 inside the top cowl assembly 30. As a result, an increase in the intake air temperature to the engine 120 may be reduced or prevented. In order to inhibit the air flow Ex more reliably, a seal 52 may be provided between the top cover member 50 and the top cowl 40. At least one of the protruding portion 44 (e.g., airflow inhibitor 44), the protruding portion 54 (e.g., airflow inhibitor 54), and the seal 52 (e.g., airflow inhibitor 52) is an example of an airflow inhibiter.

As described above, in the outboard motor 100 according to the present preferred embodiment, the exhaust channel 36 extending from the discharge port 74 of the fan 70 to the exhaust port 32 in the top cowl assembly is defined by the surface of the top cowl 40 and the surface of the top cover member 50. Therefore, with the outboard motor 100 according to the present preferred embodiment, the space between the top cowl 40 and the top cover member 50 may be used as the exhaust channel 36 to exhaust air without providing a dedicated element to define the exhaust channel to exhaust heat, and the outboard motor 100 may have a lighter, smaller, and simpler configuration.

In the outboard motor 100 according to the present preferred embodiment, the exhaust port 32 is located in the foremost portion of the top cowl assembly 30. Therefore, the exhaust port 32 may be located at a position closest to the hull 200, i.e., at a position that is less likely to receive waves and splashes due to the presence of the hull 200, and thus it is possible to effectively prevent water from entering the inside of the top cowl assembly 30 through the exhaust port 32.

The present invention is not limited to the preferred embodiments described above and may be modified to various forms without departing from the spirit thereof and, for example, may be modified as described below.

The configuration of the vessel 10 according to the above preferred embodiments is merely an example and may be modified in various ways. For example, according to the above preferred embodiments, the exhaust port 32 may be located in a portion of the top cowl assembly 30 other than the foremost portion. According to the above preferred embodiments, although the exhaust port 32 is provided between the top cowl 40 and the top cover member 50, the exhaust port 32 may be provided in other areas in the top cowl assembly 30. According to the above preferred embodiments, the width of the exhaust port 32 may be smaller than the height of the exhaust port 32, or the width of the exhaust port 32 may be equal or substantially equal to the height of the exhaust port 32.

According to the above preferred embodiments, although the color of the front surface of the louver 33 of the exhaust port 32 is different from the colors of other areas of the louver 33, they may be the same color. The louver 33 may also be omitted.

According to the above preferred embodiments, although the exhaust channel 36 has a descending slope from the discharge port 74 of the fan 70 toward the exhaust port 32, the exhaust channel 36 may extend in the horizontal direction or have an ascending slope. According to the above preferred embodiments, although the exhaust channel 36 is provided at a position that does not overlap with the fan 70 when viewed in the up-down direction, the exhaust channel 36 may be provided at a different position. According to the above preferred embodiments, although the exhaust channel 36 is defined by the surface of the top cowl 40 and the surface of the top cover member 50, the exhaust channel 36 may be defined by different members.

According to the above preferred embodiments, although the discharge channel 76 of the fan 70 extends in the horizontal direction, the discharge channel 76 may extend in a direction other than the horizontal direction.

According to the above preferred embodiments, although the discharge port 74 of the fan 70 is located at the eccentric position in the right-left direction of the outboard motor 100 and the exhaust port 32 is located at the center of the outboard motor 100 in the right-left direction, the position of the discharge port 74 and/or the exhaust port 32 may be changed as appropriate.

According to the above preferred embodiments, although the protruding portion 44, the protruding portion 54, and the seal 52 are provided as airflow inhibiters that inhibit airflow from the exhaust channel 36 to the space 39 facing the intake port 34 inside the top cowl assembly 30, a different configuration may be used as the airflow inhibiter.

According to the above preferred embodiments, although the fan 70 is driven by the engine 120, the fan 70 may be driven by a different configuration (e.g., electric motor).

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
an engine;
a fan to suction air from around the engine and discharge the air through a discharge port; and
a top cowl assembly including:
a top cowl to house the engine and the fan;
a cover to cover at least a portion of an outside of the top cowl; and
an exhaust port to communicate with the discharge port via an exhaust channel, at least a portion of the exhaust channel being defined by a surface of the top cowl and a surface of the cover.

2. The outboard motor according to claim 1, wherein the exhaust port is located in a front portion of the top cowl assembly.

3. The outboard motor according to claim 1, wherein the exhaust channel has a descending slope from the discharge port toward the exhaust port.

4. The outboard motor according to claim 1, wherein a width of the exhaust port is larger than a height of the exhaust port.

5. The outboard motor according to claim 1, wherein the fan includes:
a rotor including a plurality of blades and rotatable around an axis extending in an up-down direction; and
a discharge channel structure that surrounds the rotor and defines a discharge channel extending to the discharge port; wherein
the discharge channel extends in a horizontal direction.

6. The outboard motor according to claim 1, further comprising a louver in the exhaust port.

7. The outboard motor according to claim 6, wherein a color of a front surface of the louver is different from colors of other areas of the louver.

8. The outboard motor according to claim 1, wherein the exhaust port is between the top cowl and the cover.

9. The outboard motor according to claim 1, wherein the exhaust channel does not overlap with the fan when viewed in an up-down direction.

10. The outboard motor according to claim 1, wherein the top cowl assembly includes:
an intake port to take in and supply air to the engine; and
an airflow inhibitor to inhibit an airflow from the exhaust channel to a space facing the intake port inside the top cowl assembly.

11. The outboard motor according to claim 1, wherein
the discharge port is eccentrically positioned in a right-left direction of the outboard motor; and
the exhaust port is located at a center of the outboard motor in the right-left direction.

12. The outboard motor according to claim 1, wherein the fan is drivable by the engine.

13. A vessel comprising:
a hull; and
the outboard motor according to claim 1 attached to a rear portion of the hull.

14. An outboard motor comprising:
an engine;
a fan to suction in air around the engine and discharge the air through a discharge port; and
a top cowl assembly including:
a top cowl to house the engine and the fan;
a cover to cover at least a portion of an outside of the top cowl; and
an exhaust port to communicate with the discharge port via an exhaust channel and located in a foremost portion of the top cowl assembly; wherein
at least a portion of the exhaust port is formed by a foremost edge of the cover.

* * * * *